United States Patent [19]

Spangler et al.

[11] 4,322,711

[45] Mar. 30, 1982

[54] FOOT PEDAL MOTOR CONTROL

[75] Inventors: Paul C. Spangler; Searle T. Spangler, both of Westport, Conn.

[73] Assignee: Blackstone Industries, Inc., Bethel, Conn.

[21] Appl. No.: 218,310

[22] Filed: Dec. 19, 1980

[51] Int. Cl.[3] ..... H01C 10/00

[52] U.S. Cl. ..... 338/153; 74/96; 74/99 R; 74/512; 338/172; 338/198; 338/200

[58] Field of Search ..... 338/153, 47, 108, 215, 338/134, 172, 174, 179, 198, 200; 74/512, 99 R, 96, 89.14, 89.15, 513, 515 R, 515 E, 478

[56] References Cited

U.S. PATENT DOCUMENTS

| | | | |
|---|---|---|---|
| 2,379,774 | 7/1949 | Wyer | 338/153 |
| 2,836,691 | 5/1958 | DiGirolamo et al. | 338/172 |
| 2,986,953 | 6/1961 | DeArmond et al. | 338/153 X |
| 4,227,066 | 10/1980 | Bulwidas, Jr. | 338/198 X |

*Primary Examiner*—C. L. Albritton

*Attorney, Agent, or Firm*—Parmelee, Johnson, Bollinger & Bramblett

[57] ABSTRACT

A foot pedal operated motor control is provided for controlling the speed of a motor. The entire motor control circuit is mounted in a foot pedal housing which circuit includes a generally disc shaped potentiometer having a rotatable and a stationary member with the movement of the rotatable member with respect to the stationary member determining the resistance of the potentiometer which controls the current to a motor whose speed is to be controlled. The disc shaped potentiometer has an opening therethrough. A foot pedal is pivotally mounted on the housing overlying the potentiometer and a helical member extends between the foot pedal on one end thereof and into the opening of the disc shaped potentiometer on the other end thereof. When the foot pedal is depressed the helical member is moved linearly turning the rotatable member with respect to the stationary member of the disc shaped potentiometer thereby varying the resistance of the potentiometer which controls the current in the motor control circuit in accordance with the movement of the foot pedal. This control is considerably less expensive than slide type or other rotary type potentiometers. The motion of the foot pedal translates a half inch of linear motion from a full off to full on position on the rotary potentiometer. Accordingly, any wear is spread over 270° of available rotation of the potentiometer. The resistance is varied from 0 to 100,000 ohms providing a wide range of motor control at an inexpensive price. Expensive couplings, linkages and gearings are not required to translate the linear motion of the pedal into a rotary motion for changing the resistance of the potentiometer.

7 Claims, 7 Drawing Figures

Fig. 5.
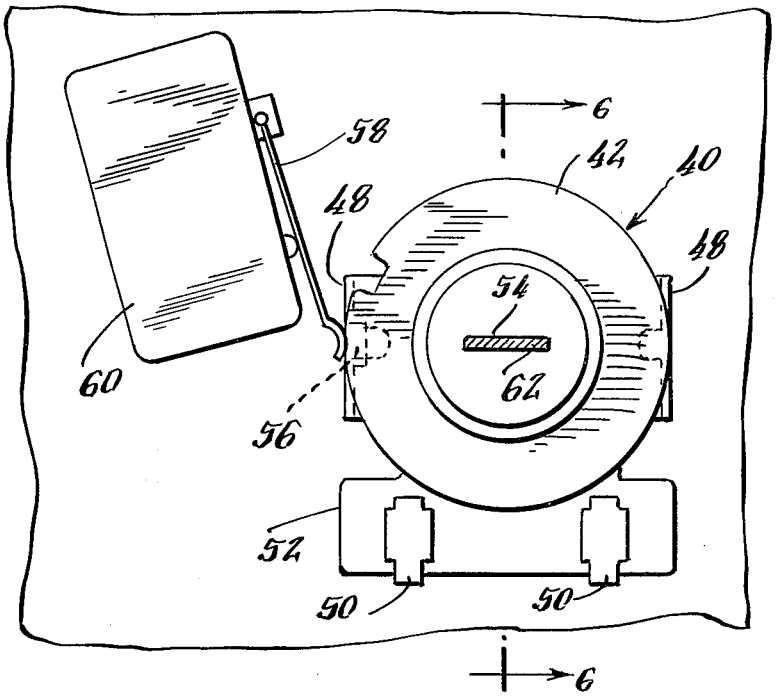
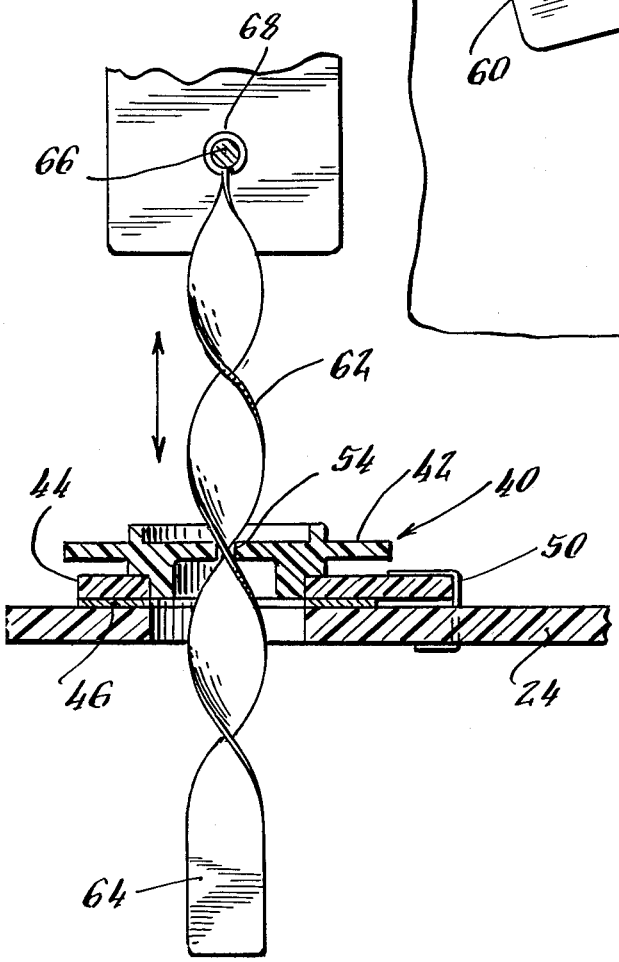
Fig. 6.
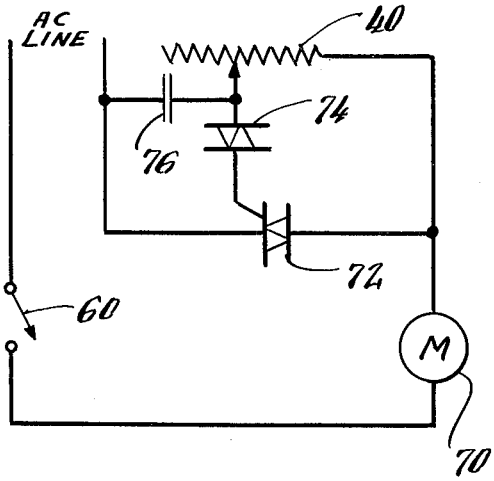
Fig. 7.

FOOT PEDAL MOTOR CONTROL

BACKGROUND OF THE INVENTION

This invention relates to a foot pedal operated motor control circuit, and more particularly, to such a circuit which employs an inexpensive rotary potentiometer operated by a foot pedal via a helical member.

A variety of motor control devices which are suitable for controlling sewing machines and other small appliances and devices using foot pedals have been proposed or utilized but all suffer the disadvantage of being bulky, expensive, subject to wear, require elaborate linkages, heat up, etc. In such control circuits, the output of the control circuit is applied to a motor for controlling its speed. The control is usually provided by changing the resistance of the control circuit by switching resistors of different values in and out or adjusting the resistance of the particular circuit normally using a potentiometer. The contacts and the resistance elements of such control circuits are subject to wear, arcing, heating and may provide a shock hazard to the user. Furthermore, portions of the control circuit are housed in different units and if potentiometers are used, either the linear or rotary type, elaborate linkages are generally required for converting the linear motion of the foot pedal into a suitable linear or rotary motion for operating the potentiometer. Furthermore, the motor control function may not provide smooth changes in speed, particularly as the contact elements wear or suffer thermal damage. In addition, these controls are sometimes complex and expensive.

SUMMARY OF THE INVENTION

Accordingly, it is an object of the present invention to provide a compact, reliable and inexpensive foot pedal motor control which is particularly suitable for controlling the speed of sewing machines, motor tools and other small appliances and apparatus.

A further object of this invention is to provide a new and improved motor control which produces a smooth, accurate and a wide range controllable change in motor speed.

A still further object of this invention is to provide a new and improved foot pedal operated motor control which is exceedingly simple, safe in operation and provides quality performance with no shock hazard to the user.

Still another object of this invention is to provide a new and improved foot pedal operated motor control in which the complete motor control and control circuit are housed in the foot pedal itself.

In carrying out this invention in one illustrative embodiment thereof, a foot pedal operated motor control is provided for controlling the speed of a motor which includes a housing having a rotary potentiometer mounted therein and an opening in the potentiometer. A foot pedal is pivotally mounted on the housing. The helical member is coupled between the foot pedal and the opening in the potentiometer for translating the linear motion of the helical member to a rotary movement in said rotary potentiometer for producing a change in resistance when the foot pedal is depressed whereby the resistance change in the rotary potentiometer controls the current applied to a motor for controlling the speed thereof. The potentiometer is also coupled to a line switch for placing a line voltage on the motor control circuit when the helical member actuates the potentiometer when the foot pedal is depressed.

BRIEF DESCRIPTION OF THE DRAWINGS

The invention, together with further aspects, objects and features thereof will be more clearly understood from the following description taken in connection with the accompanying drawings.

FIG. 5 is a greatly enlarged top view of the rotary potentiometer, switch combination employed in the motor control foot pedal of the present invention.

FIG. 6 is a cross sectional view taken along line 6—6 of FIG. 5.

FIG. 7 illustrates a simplified schematic diagram of the type of motor control circuit which may be employed in the foot pedal control of the present invention.

DESCRIPTION OF THE PREFERRED EMBODIMENTS

Figure 1:
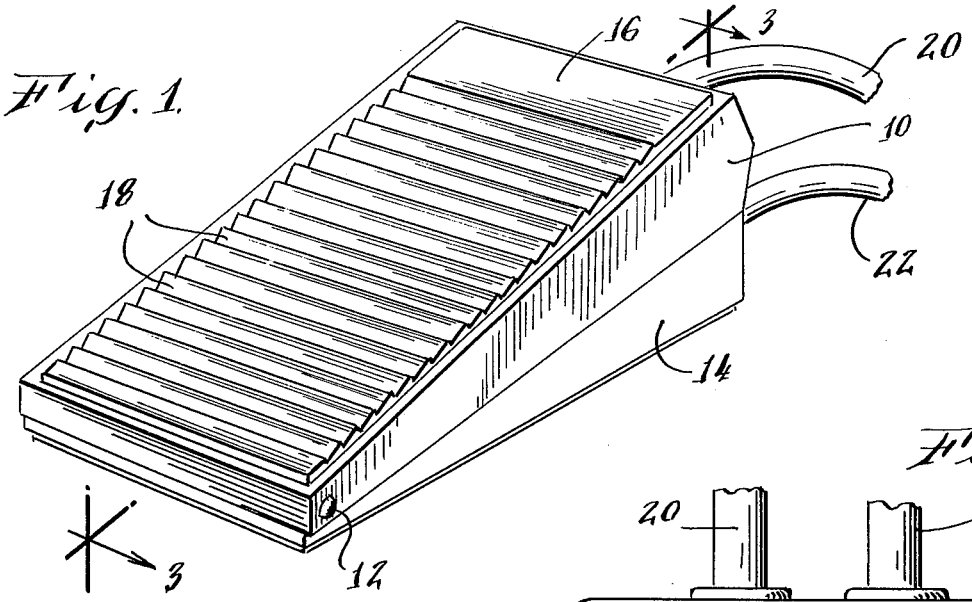
FIG. 1 is a perspective view of the foot pedal motor control circuit embodied in the present invention.
Figure 2:
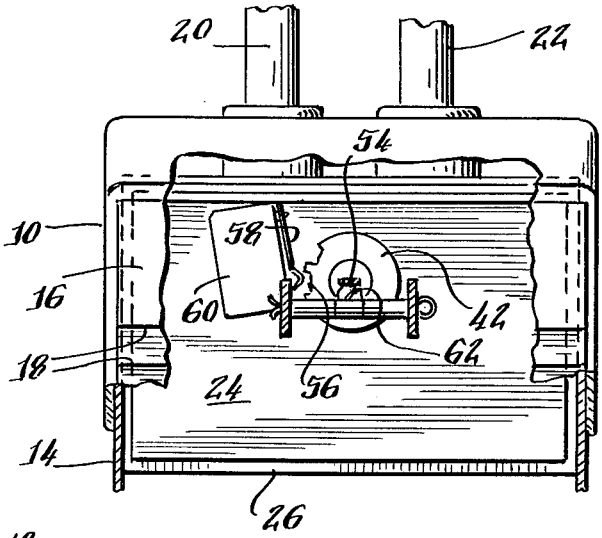
FIG. 2 is a partial top view, partially broken away of FIG. 1.

Referring now to FIG. 1, a foot pedal 10 is pivotally mounted on a pivot 12 to a housing 14. The foot pedal 10 has an upper covering 16 thereon containing a saw toothed pattern 18 for providing a nonslip surface which may be contacted by the foot of the user. A power cord 20 and a motor control cord 22, which is adapted to be coupled to the motor to be controlled, are both coupled into the interior of the housing 14.

Figure 3:
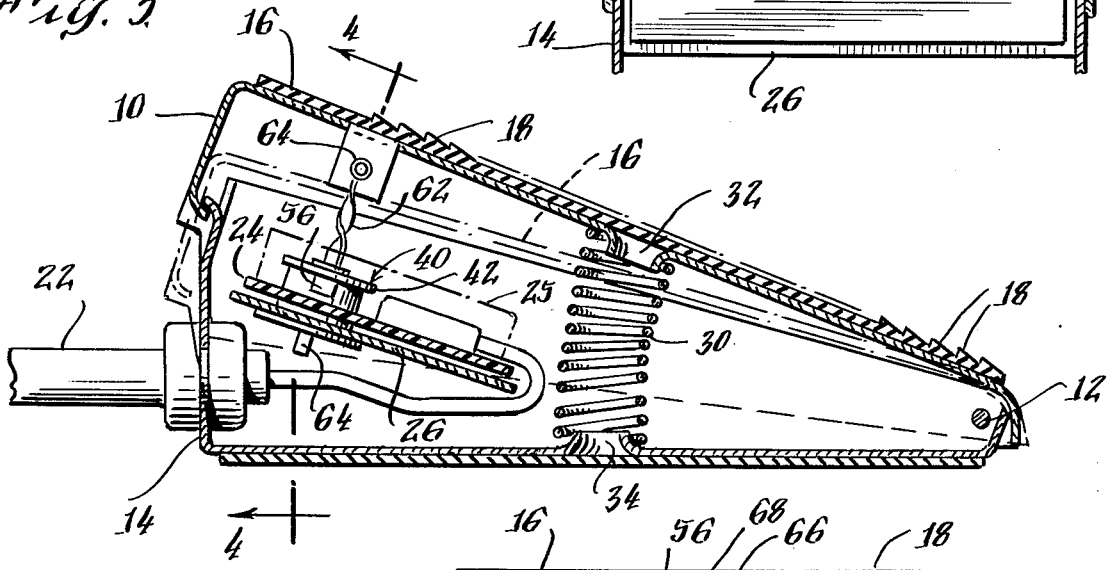
FIG. 3 is a cross sectional view taken along line 3—3 of FIG. 1.
Figure 4:
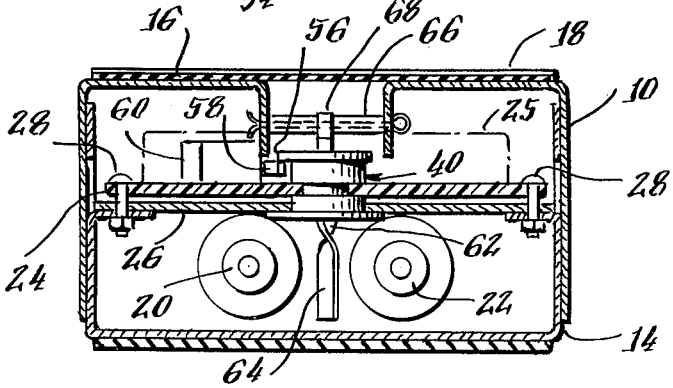
FIG. 4 is a cross sectional view taken along lines 4—4 of FIG. 3 with the foot pedal of FIG. 3 being completely depressed.

As will be more clearly seen from looking at the interior of the housing, as shown in FIGS. 3 and 4, a motor control circuit is provided which is generally identified with the reference numeral 25. The motor control circuit 25 is mounted on a circuit board 24 which is attached to a base 26 by bolts 28. The motor control circuit 25 may be any suitable type for varying the current, and therefore controlling the speed of a motor in accordance with the application and the type of motor which is employed. The specific details of the motor control circuit 25 are considered conventional and do not form a part of the present invention. However, the rotary potentiometer which forms a part of the motor control circuit 25 and the helical member for driving the potentiometer ultimately control the current to the motor being controlled and accordingly constitutes a part of the present invention and is described in detail hereinafter.

The foot pedal 10 may be of any suitable type and performs the function of actuating the motor control circuit 25 when depressed. As will best be seen in FIG. 3, the foot pedal 10 is pivotally mounted on a pivot 12 extending through the housing 14. A compressible spring 30 is positioned on protruding studs 32 and 34 on the foot pedal 10 and housing 14, respectively. The spring 30 normally biases the foot pedal 10 upward and the motor control circuit 25 is normally inactive in this position. Also, when the foot is released from the foot pedal 10, the spring 30 returns the foot pedal 10 to its upper or inactivated position turning off the motor control circuit in a manner to be described.

A rotary potentiometer, referred to generally with the reference numeral 40, includes a rotary element 42, a stationary variable resistance element 44 and a metallic base 46 having mounting legs 48 (see FIG. 6). Electrical connector terminals 50 which are mounted on a phenolic board extension 52, which also forms a part of the stationary member 44, provides a means for making electrical connections to and tapping off the variable resistance which occurs between the terminals 50. The potentiometer 40 has an opening or slot 54 extending through the rotary element 42 and accordingly through the entire potentiometer 40. The rotary element 42 also has a downwardly extending leg of projection 56 which in the inactive position of the potentiometer bears on a pivotal spring arm 58 of a line switch 60. When the rotary element is actuated and turned, the leg 56 rotates clockwise releasing the spring arm 58 which pivots outwardly closing the contacts of switch 60 placing power from the line cord 60 on the motor control circuit 25.

A suitable type of rotary potentiometer 40 for the present application and the one which has been described is type U 201 manufactured by CTS of Elkhart, Ind.

In order to translate the linear movement of the foot pedal when it is actuated by the foot of the user into a rotary motion, a helical member 62 is utilized which is coupled between the foot pedal 10 and the opening 54 of the potentiometer 40. As will best be seen in FIG. 6, the helical element 62 has an eyelet 64 formed on one end thereof which is mounted on a suspended shaft 66 on the underside of the foot pedal 10. The other end 64 of the helical member 62 is flat and extends through the opening 54 in the rotary element 42 of the rotary potentiometer 40. Accordingly, eyelet end 64 of the helix is fixed to the foot pedal 10 while the flat end 64 fits through the opening 54 and is free to move in and out thereof.

In operation when the foot pedal 10 is depressed the helical member 62 moves linearly and is forced down through the opening 54 in the rotary member 42 of the rotary potentiometer 40 rotating the rotary member 42 because of the helical curvature of the helical member 62. At the same time the leg 56 has released and closed the contacts of the switch 60 placing power on the motor control circuit 25. The amount of rotation of the rotary member 42 of the potentiometer determines the resistance of the rotary potentiometer 40 which controls the current applied to the motor from the motor control circuit 25. This arrangement is very advantageous because the helical member 62 translates a half inch of linear motion applied to the foot pedal 10 from full off to a full on position of the rotary potentiometer 40. The foot pedal control spreads the value of resistance of the rotary potentiometer over a 270° arc which limits the wear on the rotary potentiometer. The potentiometer, which is relatively inexpensive, provides a change in resistance of 0 to 100 kohms over a 270° angle. The control thus provided is smooth, even and spread over a relatively long arc.

As has been indicated, a conventional motor control circuit may be utilized. A simplified version of an electronic motor control circuit is illustrated in FIG. 7 which includes the line switch 60, the potentiometer 40, a motor 70 which is to be controlled, a capacitor 76, a triac 72 and a diac 74. Both the triac 72 and the diac 74 are bidirectional semi-conductors, and accordingly the circuit illustrated in FIG. 7 is a full wave circuit.

In operation, depression of the foot pedal 10 varies the resistance of the rotary potentiometer 40 changing the voltage applied to capacitor 76 and thus to the bidirectional diac switch 74 which controls the phase of the firing of the triac 72 and accordingly varies the current applied from the AC line to the motor 70 to control the speed thereof in accordance with the setting of the potentiometer 40. As has been previously stated, different types of motor control circuits can be employed with greater degrees of sophistication where desired. However, the translation of the linear to the rotary motion afforded by the foot pedal 10 and its associated helical member 62 would be employed in the control of and the variation of the resistance in such circuits.

The present motor control circuit which is foot pedal operated and translates a very short throw or depression of the foot pedal into a 270° rotation of a rotary potentiometer for changing the resistance thereof and varying the current which is applied to the motor for controlling the speed thereof offers a very simple, inexpensive construction employing a very cheap rotary potentiometer. The circuit is simple, accurate, easy to operate and easy to control. Since a large angle is used by the potentiometer for the variation of its resistance, less wear and tear results improving the reliability of the circuit. It is also a decided advantage in having the entire motor control circuit mounted in the foot pedal per se which offers the advantage of simplicity, as well as a compactness.

Since other changes and modifications varied to fit particular operating requirements and environments will be apparent to those skilled in the art, the invention is not considered limited to the examples chosen for purposes of illustration, and covers all changes and modifications which do not constitute a departure from the true spirit and scope of this invention.

What is claimed is:

1. A foot pedal operated motor control for controlling the speed of a motor comprising:

a housing having a motor control circuit mounted therein, said motor control circuit including a generally disc shaped potentiometer with rotatable and stationary members in said housing, said potentiometer having a resistance which is determined by the position of said rotatable member with respect to said stationary member, said disc shaped potentiometer having an opening therethrough, a foot pedal pivotally mounted on said housing overlying said potentiometer, a helical member extending between said foot pedal on one end thereof and into said opening of said disc shaped potentiometer on the other end thereof, said foot pedal on being depressed moving said helical element in a linear direction and turning said movable member with respect to said stationary member of said disc shaped potentiometer thereby varying the resistance of said potentiometer and controlling the current in said motor control circuit in accordance with the movement of said foot pedal.

2. The foot pedal operated motor control set forth in claim 1 wherein said one end of said helical member is fixedly mounted to the underside of said foot pedal and said other end extends into said opening and is free to move through said opening when said foot pedal is depressed thereby rotating said rotatable element of said disc shaped potentiometer as it moves therethrough.

3. The foot pedal operated motor control set forth in claim 1 having a line voltage switch coupled to said disc shaped potentiometer, said switch being operated by said potentiometer when said foot pedal is depressed.

4. The foot pedal operated motor control set forth in claim 1 having a spring bias means for normally biasing said foot pedal away from said housing and said potentiometer until foot pressure is applied, said biasing means returning said foot pedal and potentiometer to inactivated positions when released.

5. A foot pedal operated motor control for controlling the speed of a motor comprising:

a housing having a rotary potentiometer mounted therein, an opening in said potentiometer, a foot pedal pivotally mounted on said housing, a helical member coupled between said foot pedal and said opening in said potentiometer for translating the linear movement of said helical member to a rotary movement in said rotary potentiometer and producing a change in resistance when said foot pedal is depressed whereby the resistance change in said rotary potentiometer controls the current applied to a motor for controlling the speed thereof.

6. The foot pedal operated motor control set forth in claim 5 wherein one end of said helical member is fixedly mounted to the underside of said foot pedal and the other end extends into said opening and is free to move through said opening when said foot pedal is depressed thereby rotating said rotary potentiometer as it moves therethrough.

7. The foot pedal operated motor control set forth in claim 5 having a line voltage switch coupled to said rotary potentiometer, said switch being operated by said potentiometer when said foot pedal is depressed.

* * * * *